United States Patent [19]

Hanus

[11] Patent Number: 4,751,888

[45] Date of Patent: Jun. 21, 1988

[54] PULSE GENERATOR FOR A SEWING MACHINE DRIVE

[75] Inventor: Helfried Hanus, Karlsruhe-Durlach, Fed. Rep. of Germany

[73] Assignee: Pfaff Haushaltmaschinen GmbH, Fed. Rep. of Germany

[21] Appl. No.: 2,966

[22] Filed: Jan. 13, 1987

[30] Foreign Application Priority Data

Jan. 15, 1986 [DE] Fed. Rep. of Germany ..... 3600938

[51] Int. Cl.[4] ..... D05B 69/24; G01D 5/34

[52] U.S. Cl. ..... 112/275; 250/231 SE

[58] Field of Search ..... 112/275, 277, 453, 67, 112/87; 318/467; 250/231 SE, 233

[56] References Cited

U.S. PATENT DOCUMENTS

| | | | |
|---|---|---|---|
| 3,683,294 | 8/1972 | Gaa | 112/275 X |
| 4,463,698 | 8/1984 | Shinozaki | 112/275 |
| 4,584,954 | 4/1986 | Soyama et al. | 112/275 |

FOREIGN PATENT DOCUMENTS

| | | | |
|---|---|---|---|
| 0750285 | 5/1970 | Belgium | 112/275 |
| 2848612 | 2/1980 | Fed. Rep. of Germany | 112/275 |

*Primary Examiner*—Peter Nerbun

*Attorney, Agent, or Firm*—McGlew and Tuttle

[57] ABSTRACT

A pulse generator for a sewing machine drive, having a shaft revolving synchronously with the main shaft of the sewing machine. The pulse generator shaft is connected with two support elements which carry a strobe disk provided with control segments of bright and dark zones, the strobe disk extends between pairs of light emitting and light receiving components. The strobe disk includes a first partial disk non-rotationally connected with one support element and a second partial disk arranged adjacent and non-rotationally connected with the other support element, the angle regions of the mutually correlated bright and dark zones of the control segments of the two partial disks differing from each other, one support element being rotatable relative to the other support element, so as to change the bright and dark zones of the strobe disk.

8 Claims, 2 Drawing Sheets

PULSE GENERATOR FOR A SEWING MACHINE DRIVE

FIELD AND BACKGROUND OF THE INVENTION

The present invention relates in general to sewing machines and in particular to a new and useful pulse generator for a sewing machine drive which includes a shaft which revolves synchronously with the main shaft of the sewing machine and a support element for a strobe disk being provided with control segments of bright and dark zones, the disk extending between light emitting and light receiving components.

SUMMARY OF THE INVENTION

The present invention is directed to a pulse generator for a sewing machine drive in which individual bright and dark zones of the control segments of the strobe disk may be altered without changing the strobe disk itself, or in the alternative without changing the pulse generator.

Accordingly, an object of the present invention is to provide a pulse generator, for a sewing machine drive having a rotatable main shaft, including a shaft which revolves synchronously with the main shaft, a first support element affixed to the shaft for rotation therewith, a second support element affixed to the shaft for rotation therewith and a strobe disk having individual bright and dark zones of control segments which may be altered. The strobe disk includes a first partial disk connected to the first support element and a second partial disk connected to the second support element adjacent the second support element. The first partial disk and the second partial disk each including control segments having bright and dark zones, the first partial disk control segments being different from the second partial disk control segments. The second support element may be rotated relative to the first support element so as to align preselected portions of the control segments of each of the first partial disk and the second partial disk. The second support element is coupled with the shaft by a setting ring so as to allow the second element to be rotated for alteration of the control segments of the second partial disk with respect to the first partial disk.

Another object of the invention is to provide a pulse generator which permits adjusting the pulse delivery junctions of the two control segments to different distances.

A further object of the invention is to provide a pulse generator, for a sewing machine drive, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
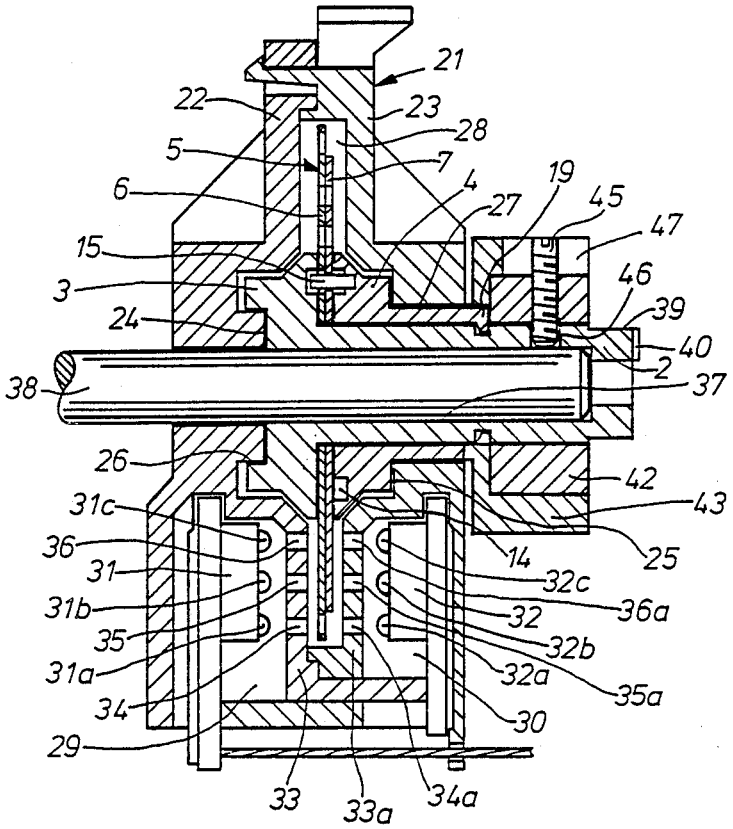
FIG. 1 is an axial section view of a pulse generator which is provided with the inventive alterable stroke disk.

Referring to the drawings in particular, a pulse generator, for a sewing machine drive having a rotatable main shaft, of the type utilized in the invention is shown in FIG. 1. A pulse generator 100 includes a shaft 2 revolving synchronously with the main shaft, and mounting means, affixed to the shaft 2 for rotation therewith, including a first support element 3 and a second support element 4. A strobe disk 5 is provided including a first partial disk 6 and a second partial disk 7. Each of the partial disks 6 and 7 include control segments 9, 10 and 9', 10' respectively. The mounting means provides relative movement between the first partial disk 6 and second partial disk 7 with respect to each other for aligning preselected portions of the openings or control segments 9 and 9' and 10 and 10'. The mounting means additionally holds the disks in a selected position for rotation with the shaft 2.

The pulse generator includes a disk carrier 1 (FIG. 1 and 2) having the shaft 2 with the support element 3 firmly connected therewith. The support element 4 is mounted on shaft 2. Between the support elements 3 and 4 the strobe disk 5 is arranged and the disk includes two partial elements 6 and 7. The partial disks 6 and 7 are opaque and have transparent zones lying on annular tracks. On the outer annular track of partial disk 6, narrow transparent windows 8 are arranged. On the central and inner annular tracks of partial disk element 6 as well as on the two annular tracks corresponding thereto which are on the partial disk 7 of smaller diameter, transparent control segments 9' and 10' are provided. The control segments 9 and 9', 10 and 10' overlap to a large extent and differ from each other only in certain end regions. Thus, a control segment 9' is lengthened in the end region **9*a*, and control segment 10 in the end region 10*a*, relative to the respective other control segment 9, 10'. Control segment 9 is lengthened in the end region 9*b*, and control segment 10' in the end region 10*b*, relative to the respective other control segment 9', 10. Therefore, the strobe disk 5 which is formed by the two partial disks 6 and 7, is transparent only in the part of the control segments 9 and 9', 10 and 10'** whose end region is not covered up.

Figure 2:
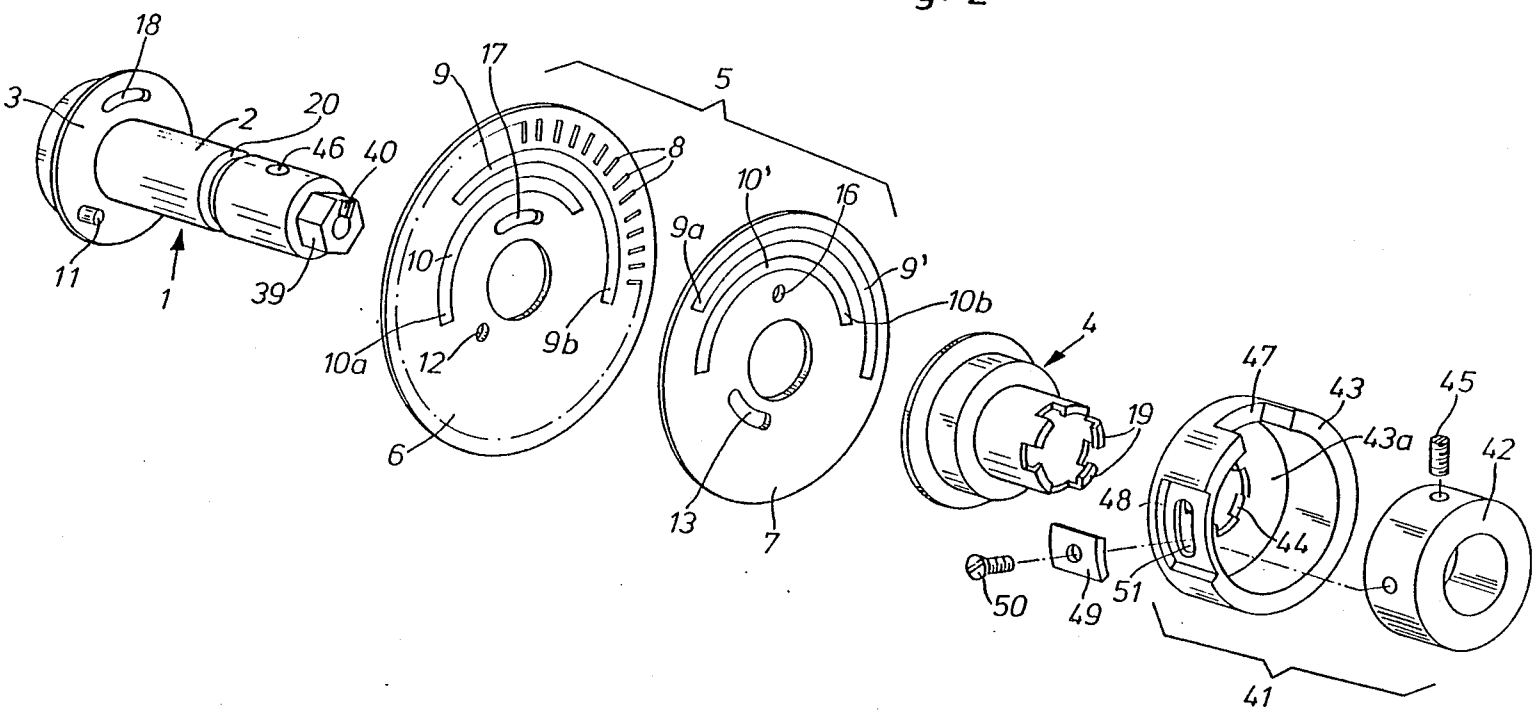
FIG. 2 is an exploded view of the strobe disk arrangement.

Partial disk 6 is secured against rotation on shaft 2 by a pin 11 which is secured in the support element 3 and which extends into a bore 12 in partial disk 6. As seen in FIG. 1 and FIG. 2 pin 11 extends into a curved slot 13 in partial disk 7 as well as into a curved groove 14 in the clamping ring 4.

Partial disk 7 is secured against rotation on shaft 2 by a pin 15 which is secured in the support element and which extends into a bore 16 in partial disk 7. Additionally pin 15 extends into a curved slot 17 in partial disk 6 as well as into a curved groove 18 in the support element 3.

The two partial disks 6 and 7 are pressed by the support element 4, which is slipped onto shaft 2, against the support element 3 and form the strobe disk 5.

The support element 4 has resilient claw teeth 19 which take support in an annular groove 20 of shaft 2.

As seen in FIG. 1 the strobe disk 5 is enclosed by a capsule 21. Capsule 21 includes two capsule parts 22 and 23 which are mounted on bearing points formed on the disk carrier 1. To this end the latter has bearing surfaces 24 and 25 acting in axial direction as well as bearing surfaces 26 and 27 acting in radial directions, which cooperate with corresponding bearing surfaces on the capsule parts 22 and 23. The capsule parts 22 and 23 are provided with recesses directed toward each other, which in the assembled state of the capsule 21 form a closed cavity 28 for the strobe disk.

Both capsule part 22 and 23 have chambers 29 and 30 to accommodate a light emission component 31, a light receiving component 32 respectively. The component 31 and 32 consist of three light sources 31*a*, 31*b* and 31*c*, and respectively, three light receivers 32*a*, 32*b*, 32*c* which are connected in suitable manner via lines with one another and with the motor control of the sewing machine. The light sources 31*a*, 31*b*, 31*c* and light receivers 32*a*, 32*b*, 32*c* are opposite each other in pairs, namely at a radial distance from the axis of rotation of the strobe disk 5 such that the outer light ray of the three light sources 31*a*, 31*b* and 31*c* pass through the path of the windows 8, while the central and inner light rays pass through the path of the control segments 9 and 9', 10 and 10'.

In the straight connection between a light source 31*a*, 31*b*, 31*c* and the respective light receiver 32*a*, 32*b*, 32*c*, in a partition 33 between chamber 29 and cavity 28 of the capsule 21, diaphragm openings 34, 35 and 36 are provided, and also, in a partition 33*a* between chamber 30 and cavity 28, diaphragm 34*a*, 35*a* and 36*a* are provided for passage of the light rays of the light sources 31*a*, 31*b*, 31*c*.

Shaft 2 of the disk carrier 1 has an axial bore 37 for slipping onto the free end of a shaft 38 revolving with the main shaft of the sewing machines. The end of shaft 2 is given a hexagonal form 39, which shows on its end face a mark 40.

For mutual displacement of the two partial disks 6 and 7 a setting ring 41 is provided on shaft 2, consisting of a clamping ring 42 and a setting sleeve 43 slipped onto it. The sleeve has a lateral abutment wall 43*a* with a center bore. Around the latter, axially directed segment-like teeth 44 are formed, which protrude into the gaps of the claw teeth 19 of the support element 4. The clamping ring 42 is secured on shaft 38 by a screw 45 which passes through a bore 46 in shaft 2. In its outer wall the setting sleeve 43 has a recess 47, the side walls of which serve as stops against the screw 45 to limit the rotation of the setting sleeve 43.

Further the setting sleeve 43 has a cutout 48, in which a ring segment 49 is displaceably guided. The latter is pressed against the lower part of the circumferential wall by a screw 50 which is screwed into the setting ring 42 and which passes through a slit 51 in the circumferential wall of the setting sleeve 43.

Attachment of the pulse generator occurs after the disk carrier 1 has been slipped onto the shaft 38 of the sewing machine. The strobe disk 5 is adjusted in a position to be determined with the mark or indicia 40 by rotating the disk carrier 1 over the hexagon 39 with an ordinary fork wrench.

Adjustment of the partial disk 7 relative to the partial disk 6 is possible after unscrewing screw 50. Upon rotation of the setting sleeve 43 on shaft 2, the teeth 44 of the setting sleeve 43 cause the rotation of the support element 4, which rotates the disk 7 via pin 15. Thus the pulse-generating junctions of the control segments 9 and 10 can be changed by displacement of the respective region.

While a specific embodiment of the invention has been shown and described in detail to illustrate the application of the principles of the invention, it will be understood that the invention may be embodied otherwise without departing from such principles.

I claim:

1. A pulse generator for a sewing machine drive having a rotatable main shaft, comprising: a shaft revolving synchronously with the main shaft; a strobe disk, including a first partial disk with a control segment opening having an angle range, a second partial disk positioned closely adjacent said first partial disk with a control segment opening having a different angle range from said first control segment opening; and, mounting means, affixed to said shaft for rotation therewith, for mounting said first and second partial disks with respect to each other for aligning preselected portions of each of said control segment openings so as to form a strobe disk control opening and for holding said first and second partial disk in a selected position for rotation with said shaft.

2. A pulse generator according to claim 1, further comprising: a first capsule part and a second capsule part, said first and second capsule parts enclosing said strobe disk, each of said first capsule part and said second capsule part including a chamber, a light emission component positioned in said first capsule part chamber and a light receiving component positioned in said second capsule part chamber so the light emission component and light receiving component are opposite each other at a radial distance from an axis of rotation of said strobe disk.

3. A pulse generator according to claim 1, wherein: said mounting means includes a first support element and a second support element and each of said first and second partial disks is connected with respective associated first and second support elements by a first and second pin, said first pin is fastened to said first support element and protrudes into a corresponding bore in said first partial disk as well as into a curved slot in said second partial disk and into a curved groove in said second support element, said second pin is fastened to said second support element and protrudes into a corresponding bore in said second partial disk as well as into a curved slot and into a curved groove in said first support element.

4. A pulse generator according to claim 3, wherein: said second support element is loosely mounted on said shaft and is coupled to said shaft with a setting ring which may be affixed for rotation with said shaft.

5. A pulse generator for a sewing machine drive having a rotatable main shaft, comprising: a shaft revolving synchronously with the main shaft; a first support element affixed to said shaft for rotation therewith; a second support element mounted on said shaft and adapted to be rotated with said shaft; a strobe disk including a first partial disk connected to said first support element and a second partial disk connected with said second support element, a face of said second disk abutting a face of said first disk, said first partial disk and said second partial disk each including control segments, the first partial disk control segment having an angle range different from the angle range of the second partial disk control segments, said second support element being rotatable relative to said first support element for aligning preselected portions of said control segments and holding said partial disks in a selected position for rotation with said shaft; a light-emitting component positioned on one side of said strobe disk; and, a light-receiving component positioned on an opposite side of said strobe disk from said light-emitting component.

6. A pulse generator according to claim 5, wherein: said first partial disk is connected with said first support element by a pin fastened to said first support element which protrudes into a corresponding bore in said first partial disk as well as into a curved slot in said second partial disk and into a curved groove in said second support element, said second partial disk is connected with said second support element by a pin fastened to said second support element which protrudes into a corresponding bore in said second partial disk as well as into a curved slot in said first partial disk and into a curved groove in said second support element.

7. A pulse generator according to claim 5, wherein: said second support element is loosely mounted on said shaft and is coupled with a setting ring, said setting ring rotatably fastened on said shaft.

8. A pulse generator for a sewing machine drive having a rotatable main shaft, comprising: a shaft revolving synchronously with the main shaft; a strobe disk, including a first partial disk with a control segment opening having an angle range, a second partial disk abutting said first partial disk, said second partial disk having a control segment opening with a different angle range from said first control segment opening; a first support element and a second support element, each of said first and second partial disks being connected with respective associated first and second support elements by a first and second pin, said first pin being fastened to said first support element and protruding into a corresponding bore in said first partial disk and into a curved slot in said second partial disk and into a curved groove in said second support element, said second pin being fastened to said second support element and protruding into a corresponding bore in said second partial disk and protruding into a curved slot and into a curved groove in said first support element, said second support element being coupled to said shaft with a setting ring and being movable relative to said shaft and said first support element so as to provide relative movement of said first and second partial disks with respect to each other for aligning preselected portions of each of said control segment openings so as to form a single strobe disk control opening and for holding said first and second partial disks in a selected position for rotation with said shaft.

* * * * *